US012729873B2

(12) United States Patent
Welch

(10) Patent No.: US 12,729,873 B2
(45) Date of Patent: Sep. 8, 2026

(54) OPEN AIR-CYCLE VENTILATING HEAT PUMP

(71) Applicant: Copeland LP, Sidney, OH (US)

(72) Inventor: Andrew M. Welch, Franklin, OH (US)

(73) Assignee: Copeland LP, Sidney, OH (US)

( * ) Notice: Subject to any disclaimer, the term of this patent is extended or adjusted under 35 U.S.C. 154(b) by 311 days.

(21) Appl. No.: 18/652,183

(22) Filed: May 1, 2024

(65) Prior Publication Data

US 2025/0341332 A1 Nov. 6, 2025

(51) Int. Cl.

| | |
|---|---|
| ***F24F 11/00*** | (2018.01) |
| ***F24F 11/65*** | (2018.01) |
| ***F24F 11/84*** | (2018.01) |
| ***F24F 13/30*** | (2006.01) |

(52) U.S. Cl.
CPC ..... *F24F 11/65* (2018.01); *F24F 11/84* (2018.01); *F24F 13/30* (2013.01)

(58) Field of Classification Search
CPC ..... F24F 11/65; F24F 11/84; F24F 13/30
See application file for complete search history.

(56) References Cited

U.S. PATENT DOCUMENTS

| | | | |
|---|---|---|---|
| RE21,510 | E | 7/1940 | Smith |
| 3,103,796 | A | 9/1963 | Dickson et al. |
| 4,207,754 | A | 6/1980 | Chaboseau et al. |
| 4,295,518 | A | 10/1981 | Rannenberg |
| RE31,281 | E | 6/1983 | Swenson et al. |
| 4,445,639 | A | 5/1984 | Kinsell et al. |
| 4,535,606 | A | 8/1985 | Rannenberg |
| 5,031,413 | A | 7/1991 | Tsuihiji et al. |
| 5,121,610 | A | 6/1992 | Atkinson et al. |

(Continued)

FOREIGN PATENT DOCUMENTS

| | | | |
|---|---|---|---|
| CN | 110779231 | A | 2/2020 |
| CN | 112944710 | A | 6/2021 |

(Continued)

OTHER PUBLICATIONS

Supplementary Search Report regarding European Patent Application No. 228207643, dated Mar. 4, 2025.

(Continued)

*Primary Examiner* — Mark A Connolly
(74) *Attorney, Agent, or Firm* — Harness, Dickey & Pierce, P.L.C.

(57) ABSTRACT

A climate-control system may include first and second turbomachines, first and second heat exchangers, and a fan. The first turbomachine may be fluidly connected with a source of outdoor air. The first and second turbomachines are operable in a compressor mode and in an expander mode. The turbomachines compress air in the compressor mode and expand air in the expander mode. The first heat exchanger may receive air from the first turbomachine. The second heat exchanger may be fluidly connected to the first heat exchanger and the second turbomachine. The fan may force air across an exterior of the first heat exchanger and force air across an exterior of the second heat exchanger. The air flowing across the exteriors of the first and second heat exchangers may be fluidly isolated from air flowing inside of the first and second heat exchangers.

20 Claims, 7 Drawing Sheets

(56) References Cited

U.S. PATENT DOCUMENTS

| | | | | |
|---|---|---|---|---|
| 5,462,110 | A * | 10/1995 | Sarver | F25B 9/004 62/277 |
| 5,628,203 | A | 5/1997 | Adolph et al. | |
| 5,689,962 | A | 11/1997 | Rafalovich | |
| 6,041,615 | A | 3/2000 | Ostersetzer et al. | |
| 6,301,922 | B1 | 10/2001 | Ochi | |
| 6,360,557 | B1 | 3/2002 | Reznik | |
| 6,619,064 | B1 | 9/2003 | Piao et al. | |
| 6,644,049 | B2 | 11/2003 | Alford | |
| 6,966,198 | B2 | 11/2005 | Piccirilli et al. | |
| 7,124,594 | B2 | 10/2006 | McRell | |
| 7,654,307 | B2 | 2/2010 | Bhatti et al. | |
| 7,827,812 | B2 | 11/2010 | Yabu et al. | |
| 7,886,556 | B2 | 2/2011 | Fujiyoshi et al. | |
| 8,439,277 | B2 | 5/2013 | Phillips | |
| 8,769,969 | B2 | 7/2014 | DeMonte et al. | |
| 8,936,071 | B2 | 1/2015 | Bruno et al. | |
| 9,188,359 | B2 | 11/2015 | Ishimoto et al. | |
| 9,777,941 | B2 | 10/2017 | Grimaldi et al. | |
| 9,885,486 | B2 | 2/2018 | Wintemute | |
| 9,970,698 | B2 | 5/2018 | Gomes et al. | |
| 10,488,059 | B2 | 11/2019 | Phillips | |
| 10,557,643 | B2 | 2/2020 | Nelson | |
| 10,707,800 | B2 | 7/2020 | Wu et al. | |
| 11,090,605 | B2 | 8/2021 | Moghaddam | |
| 11,326,795 | B2 | 5/2022 | Phillips | |
| 11,371,728 | B2 | 6/2022 | Goel et al. | |
| 2002/0164944 | A1 | 11/2002 | Haglid | |
| 2004/0089000 | A1 | 5/2004 | Christen et al. | |
| 2005/0023362 | A1 | 2/2005 | Wacker | |
| 2006/0236715 | A1 | 10/2006 | Nikai et al. | |
| 2007/0137238 | A1 | 6/2007 | Hu | |
| 2010/0139306 | A1* | 6/2010 | Krenik | F25B 9/004 62/402 |
| 2011/0100043 | A1 | 5/2011 | Matubara et al. | |
| 2012/0064818 | A1 | 3/2012 | Kurelowech | |
| 2012/0291463 | A1 | 11/2012 | O'Brien | |
| 2016/0193558 | A1* | 7/2016 | Jeong | B01D 46/62 55/486 |
| 2016/0265805 | A1 | 9/2016 | Landry | |
| 2017/0108249 | A1* | 4/2017 | Morishita | F25B 9/008 |
| 2018/0252487 | A1 | 9/2018 | Wintemute et al. | |
| 2018/0328603 | A1 | 11/2018 | Lee et al. | |
| 2020/0130849 | A1 | 4/2020 | Hennig et al. | |
| 2020/0173671 | A1 | 6/2020 | Rowe et al. | |
| 2020/0215870 | A1 | 7/2020 | Androulakis et al. | |
| 2020/0236820 | A1 | 7/2020 | Meadows et al. | |
| 2020/0240693 | A1 | 7/2020 | Khalili et al. | |
| 2020/0271354 | A1 | 8/2020 | Jayarathne | |
| 2021/0048216 | A1* | 2/2021 | Takata | F24F 11/49 |
| 2021/0188448 | A1 | 6/2021 | Retersdorf | |
| 2022/0099313 | A1 | 3/2022 | Dean | |
| 2022/0397291 | A1 | 12/2022 | Welch | |
| 2024/0229810 | A1* | 7/2024 | Beers | F04D 27/009 |

FOREIGN PATENT DOCUMENTS

| | | | | |
|---|---|---|---|---|
| CN | 113028670 | A | 6/2021 | |
| CN | 117261530 | A | 12/2023 | |
| EP | 2992272 | A1 | 3/2016 | |
| EP | 3505838 | A1 | 7/2019 | |
| EP | 3800076 | A1 | 4/2021 | |
| JP | 2002235933 | A | 8/2002 | |
| KR | 101118167 | B1 | 3/2012 | |
| WO | 00/36344 | A1 | 6/2000 | |
| WO | 2020116551 | A1 | 6/2020 | |
| WO | 2022248995 | A1 | 12/2022 | |
| WO | WO-2023093624 | A1 * | 6/2023 | F28F 27/02 |
| WO | WO-2024053206 | A1 * | 3/2024 | F25D 21/08 |

OTHER PUBLICATIONS

Search Report regarding European Patent Application No. 251735692, dated Sep. 11, 2025.

International Search Report regarding Application No. PCT/US2022/030334 dated Sep. 2, 2022.

Written Opinion of the ISA regarding Application No. PCT/US2022/030334 dated Sep. 2, 2022.

Separate sensible and latent cooling systems: A critical review of the state-of-the-art and future prospects, Nawaz et al., 2018.

Ch. 26 Air-to-Air Recovery Equipment, 2020 ASHRAE Handbook-HVAC Systems and Equipment(SI).

Non-Final Office Action regarding U.S. Appl. No. 17/346,007 dated Jun. 15, 2023.

Final Office Action regarding U.S. Appl. No. 17/346,007 dated Oct. 26, 2023.

Notice of Allowance regarding U.S. Appl. No. 17/346,007 dated Feb. 15, 2024.

Air cycle refrigeration—Food Refrigeration & Process Engineering Research Centre, The Grimsby Institute of Further & Higher Education, https://grimsby.ac.uk/documents/frperc/research/aircycle_research.pdf (At least as early as May 6, 2022).

Lesson 9, Air cycle refrigeration systems, Version 1 ME, IIT Kharagpur (Jan. 2018).

* cited by examiner

OPEN AIR-CYCLE VENTILATING HEAT PUMP

FIELD

The present disclosure relates to a heat-pump system, and more particularly, to an open air-cycle ventilating heat pump.

BACKGROUND

This section provides background information related to the present disclosure and is not necessarily prior art.

A climate-control system (e.g., a heat-pump system, a refrigeration system, or an air conditioning system) may be operable to cool and/or heat a space (e.g., a room within a building or a space within a container or enclosure). The present disclosure provides a climate-control system that is operable to cool or heat the space while also delivering fresh outdoor air into the space and exhausting air from the space back outdoors. Such an arrangement provides improved comfort while also improving air quality and health.

SUMMARY

This section provides a general summary of the disclosure and is not a comprehensive disclosure of its full scope or all of its features.

In one example form, the present disclosure provides a climate-control system that may include first and second turbomachines, first and second heat exchangers, and one or more fans. The first turbomachine may be fluidly connected with a source of outdoor air and operable in a compressor mode and in an expander mode. The first turbomachine is configured to compress air in the compressor mode and expand air in the expander mode. The second turbomachine may be operable in a compressor mode and in an expander mode. The second turbomachine is configured to compress air in the compressor mode and expand air in the expander mode. The first heat exchanger may be fluidly connected to the first turbomachine and may receive air from the first turbomachine in the compressor mode and in the expander mode. The second heat exchanger may be fluidly connected to the first heat exchanger and the second turbomachine. The second heat exchanger may receive air from the first heat exchanger. The second heat exchanger may provide air to the second turbomachine in the compressor mode and in the expander mode. The one or more fans may force air from the source of outdoor air across an exterior of the first heat exchanger and force indoor return air across an exterior of the second heat exchanger. The air flowing across the exterior of the first heat exchanger may be fluidly isolated from air flowing inside of the first heat exchanger. The return air flowing across the exterior of the second heat exchanger may be fluidly isolated from air flowing inside of the second heat exchanger.

In some configurations of the climate-control system of the above paragraph, the first and second heat exchangers are disposed within an internal cavity of a housing.

In some configurations of the climate-control system of the above paragraphs, the housing includes a return-air inlet, an outdoor-air inlet, and an air-exhaust outlet.

In some configurations of the climate-control system of any one or more of the above paragraphs, the one or more fans force air from the source of outdoor air into the internal cavity of the housing through the outdoor-air inlet and force the return air into the internal cavity of the housing through the return-air inlet.

In some configurations of the climate-control system of any one or more of the above paragraphs, the one or more fans force the air from the source of outdoor air and the return air out of the internal cavity of the housing after the air from the source of outdoor air and the return air flow across the exteriors of the first and second heat exchangers, respectively.

In some configurations of the climate-control system of any one or more of the above paragraphs, the air-exhaust outlet is disposed between the return-air inlet and the outdoor-air inlet.

In some configurations of the climate-control system of any one or more of the above paragraphs, the first and second turbomachines are disposed outside of the internal cavity of the housing.

In some configurations, the climate-control system of any one or more of the above paragraphs may include a supply-air outlet that receives air from the second turbomachine and provides the air to an indoor space.

In some configurations of the climate-control system of any one or more of the above paragraphs, the supply-air outlet is attached to the housing, and wherein air flowing through the supply-air outlet is fluidly isolated from air within the internal cavity flowing across the exteriors of the first and second heat exchangers.

In some configurations of the climate-control system of any one or more of the above paragraphs, the return-air inlet and the supply-air outlet are disposed adjacent to each other at a first end of the housing.

In some configurations of the climate-control system of any one or more of the above paragraphs, the outdoor-air inlet is disposed at a second end of the housing opposite the first end.

In some configurations of the climate-control system of any one or more of the above paragraphs, the air-exhaust outlet is disposed between the first and second ends of the housing.

In some configurations, the climate-control system of any one or more of the above paragraphs may include: a first reversing valve in fluid communication with the first turbomachine and the first heat exchanger; and a second reversing valve in fluid communication with the second turbomachine and the second heat exchanger. The first and second reversing valves may be movable between first and second positions.

In some configurations of the climate-control system of any one or more of the above paragraphs, the climate-control system is operable in a cooling mode and in a heating mode.

In some configurations of the climate-control system of any one or more of the above paragraphs, in the cooling mode: the first turbomachine operates in the compressor mode, the first reversing valve is in the first position, the second turbomachine operates in the expander mode, and the second reversing valve is in the second position.

In some configurations of the climate-control system of any one or more of the above paragraphs, in the heating mode: the first turbomachine operates in the expander mode, the first reversing valve is in the second position, the second turbomachine operates in the compressor mode, and the second reversing valve is in the first position.

In some configurations of the climate-control system of any one or more of the above paragraphs, each of the first and second turbomachines includes a first port and a second port.

In some configurations of the climate-control system of any one or more of the above paragraphs, the first port is an outlet in the compressor mode and the second port is an inlet in the compressor mode.

In some configurations of the climate-control system of any one or more of the above paragraphs, the first port is an inlet in the expander mode and the second port is an outlet in the expander mode.

In some configurations of the climate-control system of any one or more of the above paragraphs, in the cooling mode: air flows from the first reversing valve to the second port of the first turbomachine, air flows from the first port of the first turbomachine to the first reversing valve, air flows from the second reversing valve to the first port of the second turbomachine, and air flows from the second port of the second turbomachine to the second reversing valve.

In some configurations of the climate-control system of any one or more of the above paragraphs, in the heating mode: air flows from the first reversing valve to the first port of the first turbomachine, air flows from the second port of the first turbomachine to the first reversing valve, air flows from the second reversing valve to the second port of the second turbomachine, and air flows from the first port of the second turbomachine to the second reversing valve.

In some configurations of the climate-control system of any one or more of the above paragraphs, air from the first turbomachine flows to the first heat exchanger and subsequently to the second heat exchanger in the cooling mode and in the heating mode.

In some configurations, the climate-control system of any one or more of the above paragraphs may include an outdoor-air conduit configured to receive outdoor ambient air from the source of outdoor air and provide the outdoor ambient air to the first turbomachine via the first reversing valve in the cooling mode and in the heating mode.

In some configurations of the climate-control system of any one or more of the above paragraphs, the first and second reversing valves are mounted to the housing outside of the internal cavity.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
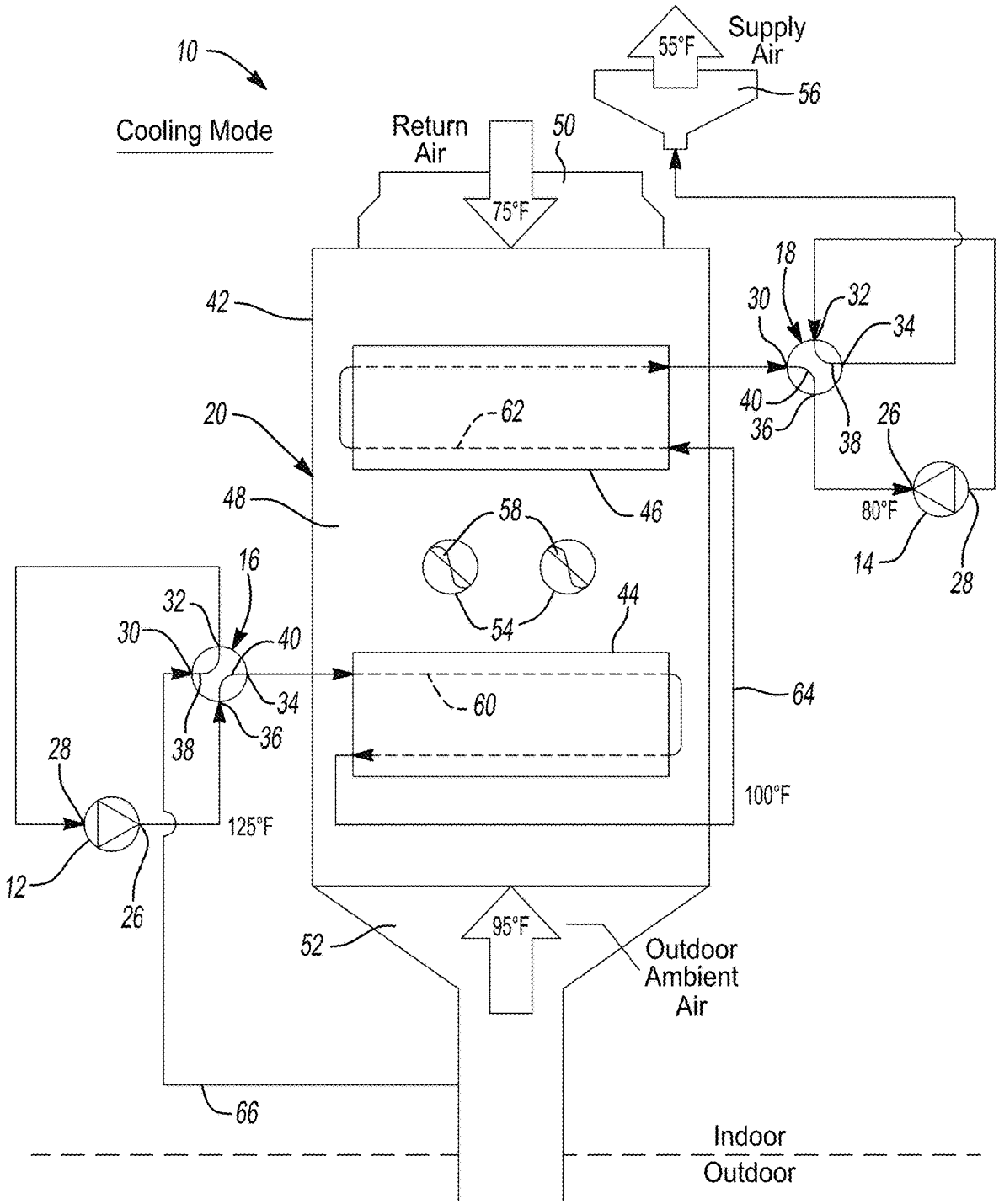
FIG. 1 is a schematic representation of a climate-control system operating in a cooling mode according to the principles of the present disclosure.

Example embodiments will now be described more fully with reference to the accompanying drawings.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-7, a heat-pump system 10 is provided. The heat-pump system 10 is an air-cycle heat pump—that is, the system 10 uses outdoor ambient air as the working fluid, rather than conventional refrigerants (such as carbon dioxide, R-32, etc.). Furthermore, the system 10 is an open-loop system that draws outdoor ambient air, circulates that air indoors (i.e., into the room or space to be cooled or heated), and exhausts indoor air back outdoors. Therefore, the system 10 is operable to heat or cool the room or space while simultaneously ventilating the room or space. The system 10 is operable in a cooling mode (FIG. 1) to cool the room or space and in a heating mode (FIG. 2) to heat the room or space.

As shown in FIGS. 1-6, the system 10 may include a first compressor/turbine (a turbomachine or compressor/expander) 12, a second compressor/turbine (a turbomachine or compressor/expander) 14, a first reversing valve 16, a second reversing valve 18, and a heat-exchanger unit 20.

Figure 7:
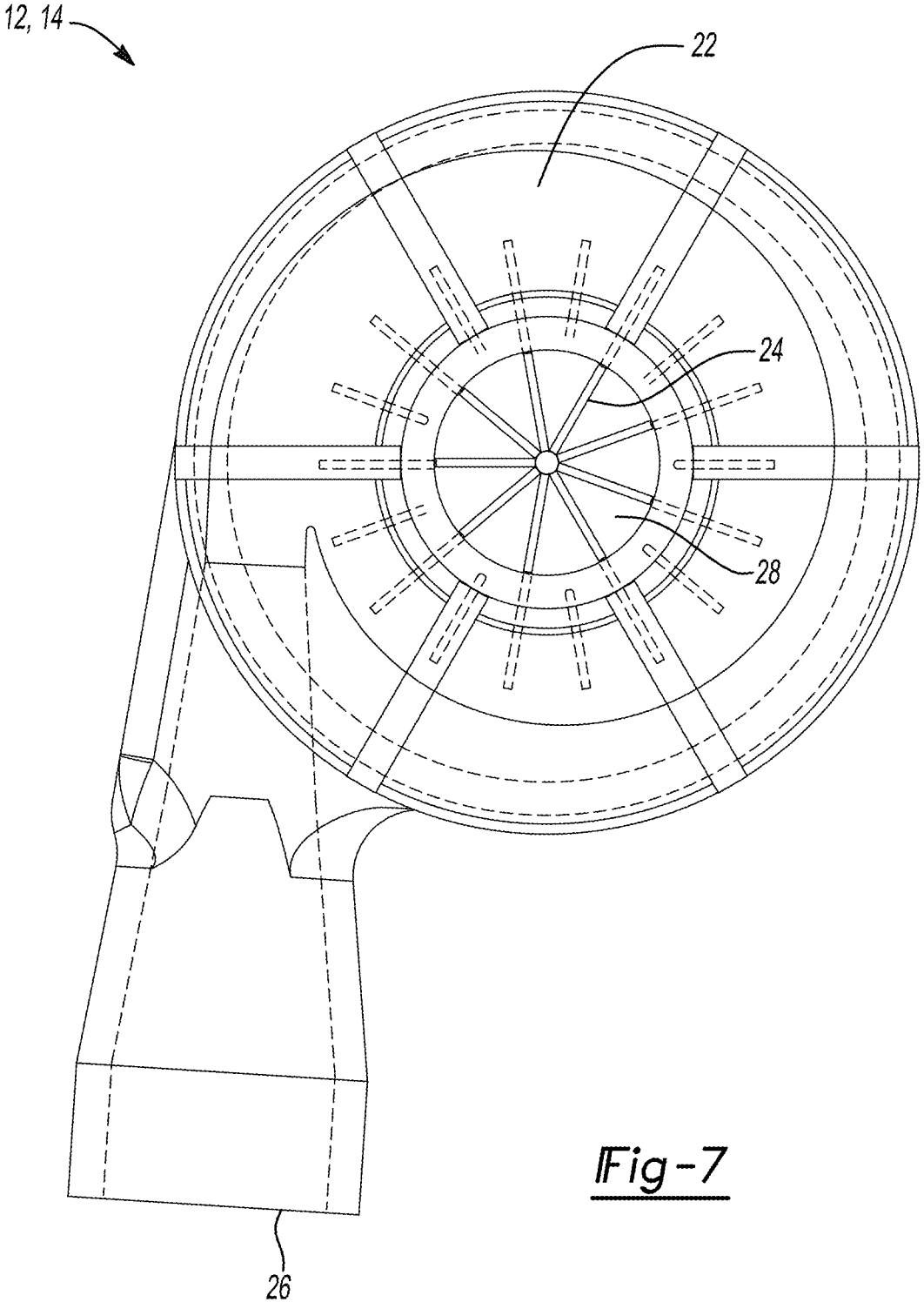
FIG. 7 is a plan view of a turbomachine of the climate-control system.

The first compressor/turbine 12 and the second compressor/turbine 14 may be similar or identical to each other. The first and second compressor/turbines 12, 14 may be operable in a compressor mode in which it compresses air and in a turbine mode (or expander mode) in which it expands air. The first and second compressor/turbines 12, 14 may be any suitable type of compressor/turbine. For example, as shown in FIG. 7, the first and second compressor/turbines 12, 14 could be centrifugal (or radial) compressor/turbines having a volute 22 and an impeller 24. A motor may rotate the impeller 24 in a first direction to operate the compressor/turbine in the compressor mode. The impeller 24 may rotate in a second direction (opposite the first direction) when the compressor/turbine is operating in the turbine mode. The volute 22 may define a first port 26 and a second port 28. The first port 26 may be an inlet to the volute in the turbine mode and an outlet to the volute in the compressor mode. The second port 28 may be an inlet to the volute in the compressor mode and an outlet to the volute in the turbine mode.

In the compressor mode, the motor rotates the impeller 24 in the first direction, which draws air into the volute 22 through the second port 28. The air is compressed as it moves through the volute from the second port 28 to the first port 26.

In the turbine mode, air flows into the volute 22 through the first port 26, and the impeller 24 of the compressor/turbine 12, 14 may be driven (in the second rotational direction) by the flow of air flowing from the first port 26 to the second port 28. The air is expanded as it moves through the volute from the first port 26 to the second port 28. In the turbine mode, the spinning impeller 24 driven by airflow may generate electricity which may be provided to the motor of the other compressor/turbine 12, 14 operating in the compressor mode (or the generated electricity could be stored in a battery or used to power any other electrical device).

It will be appreciated that the first and second compressor/turbines 12, 14 could be any other suitable type of compressor/turbine, such as an axial-type compressor/turbine, for example.

Figure 2:
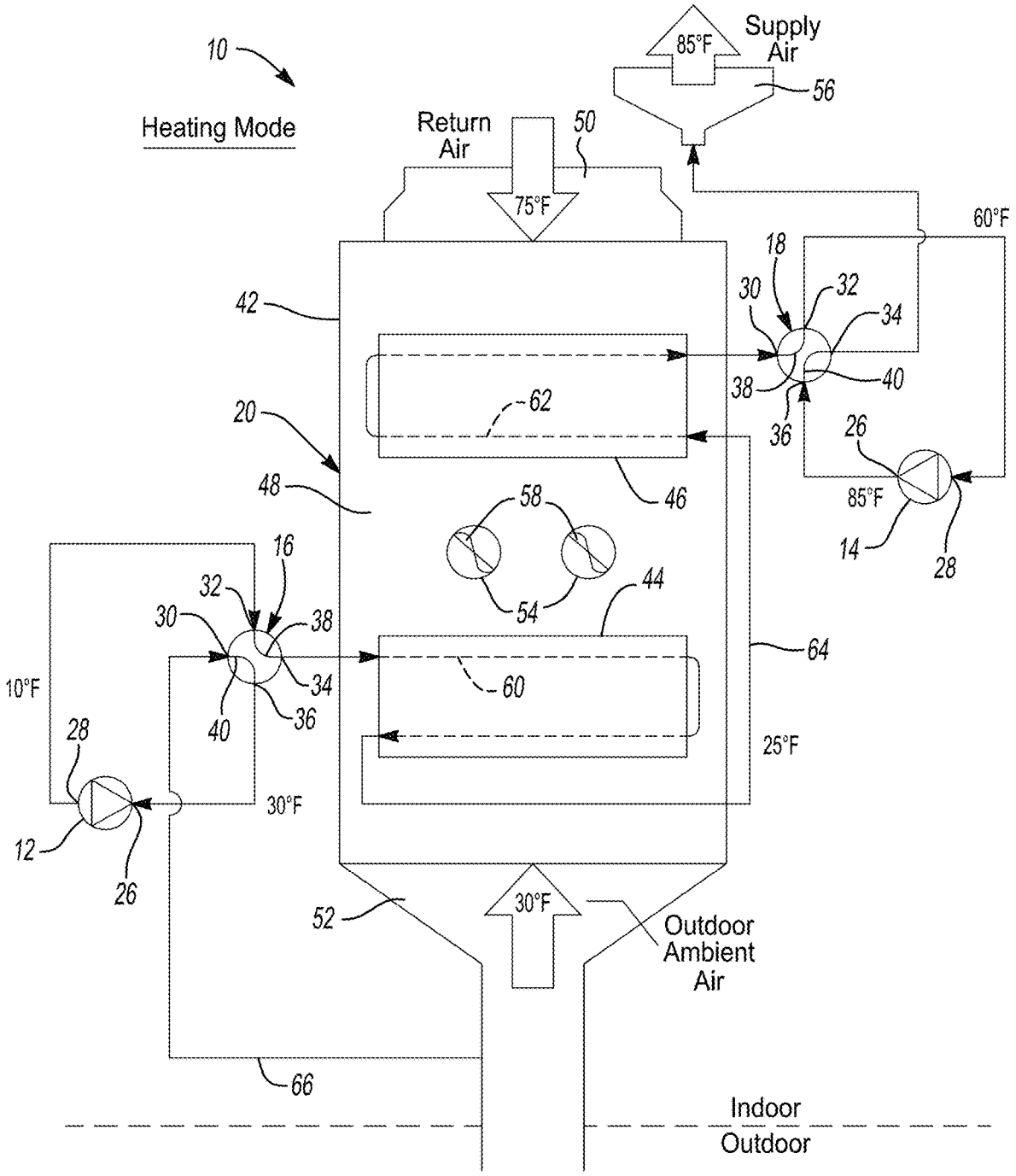
FIG. 2 is a schematic representation of the climate-control system operating in a heating mode.
Figure 3:
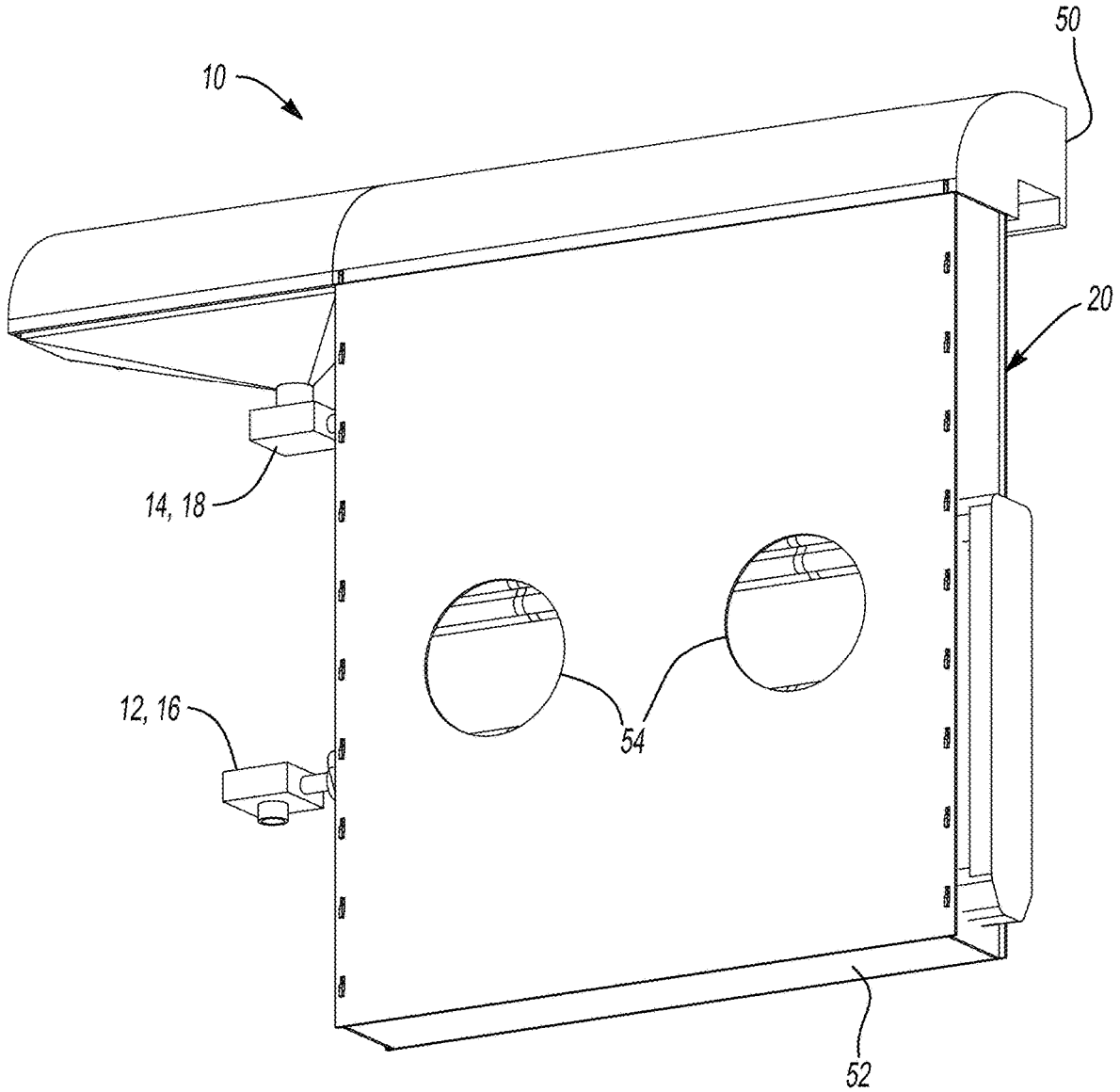
FIG. 3 is a perspective view of the climate-control system.
Figure 4:
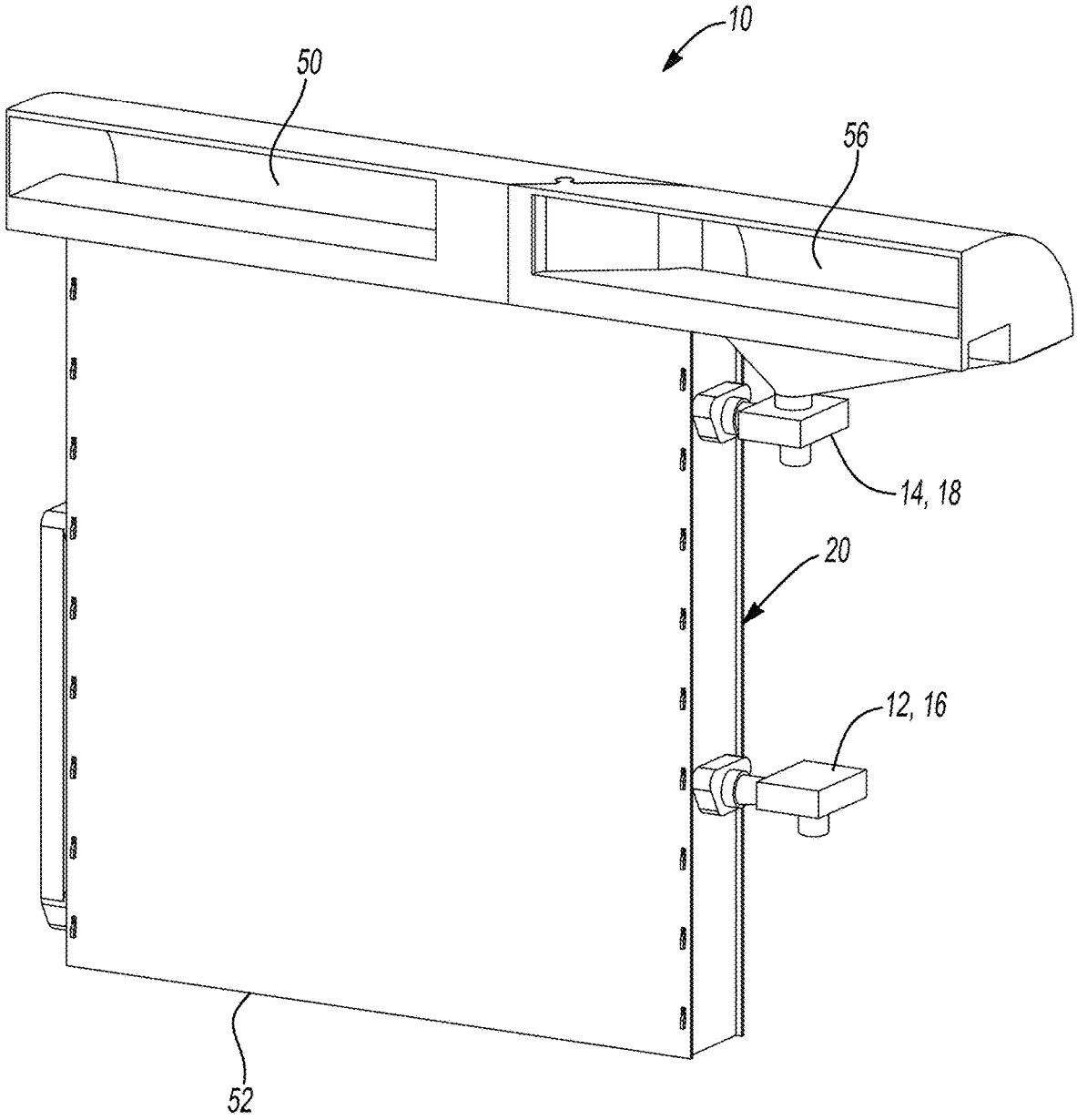
FIG. 4 is another perspective view of the climate-control system.
Figure 5:
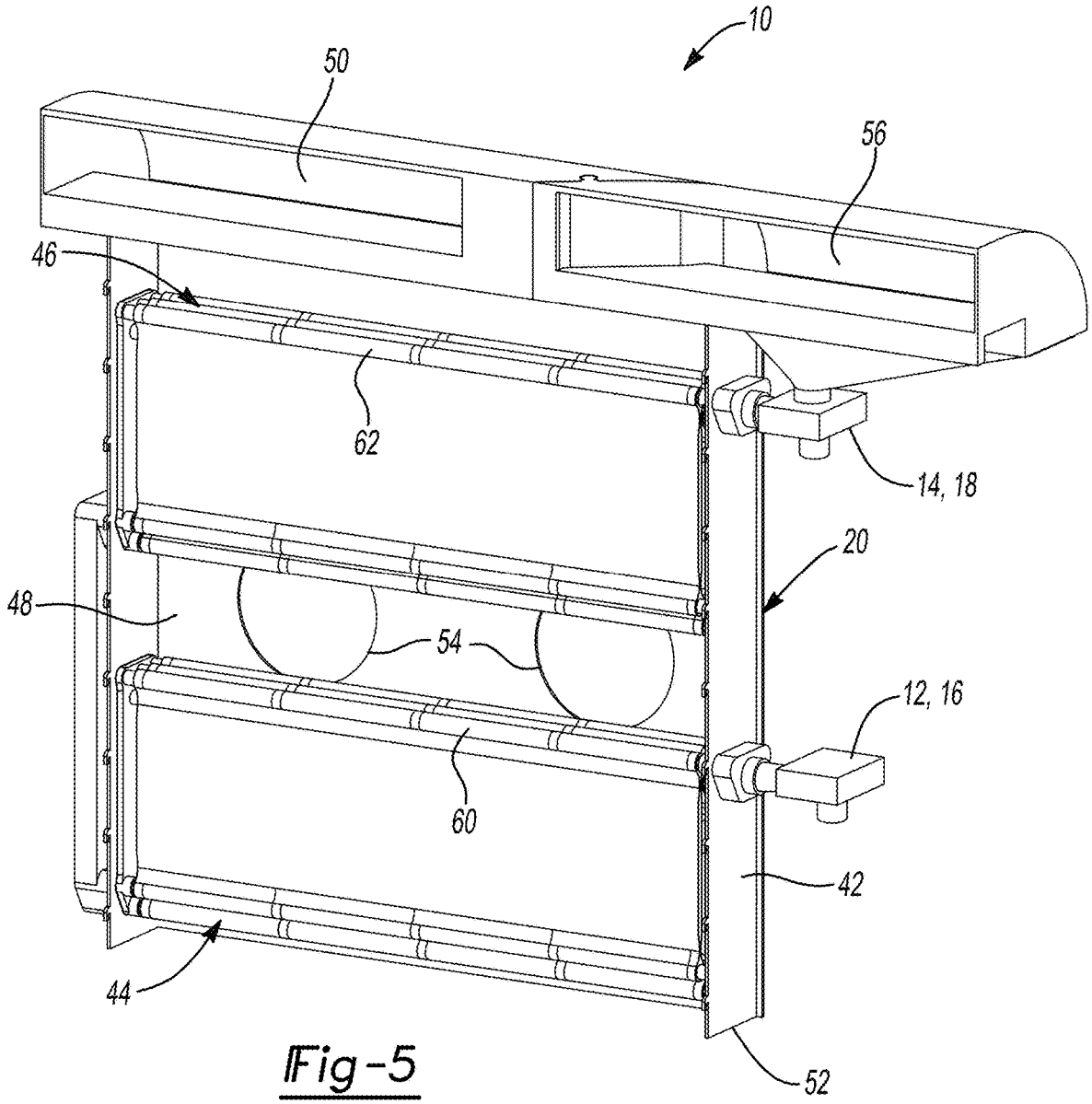
FIG. 5 is a perspective view of the climate-control system with a portion of a housing of the system removed.
Figure 6:
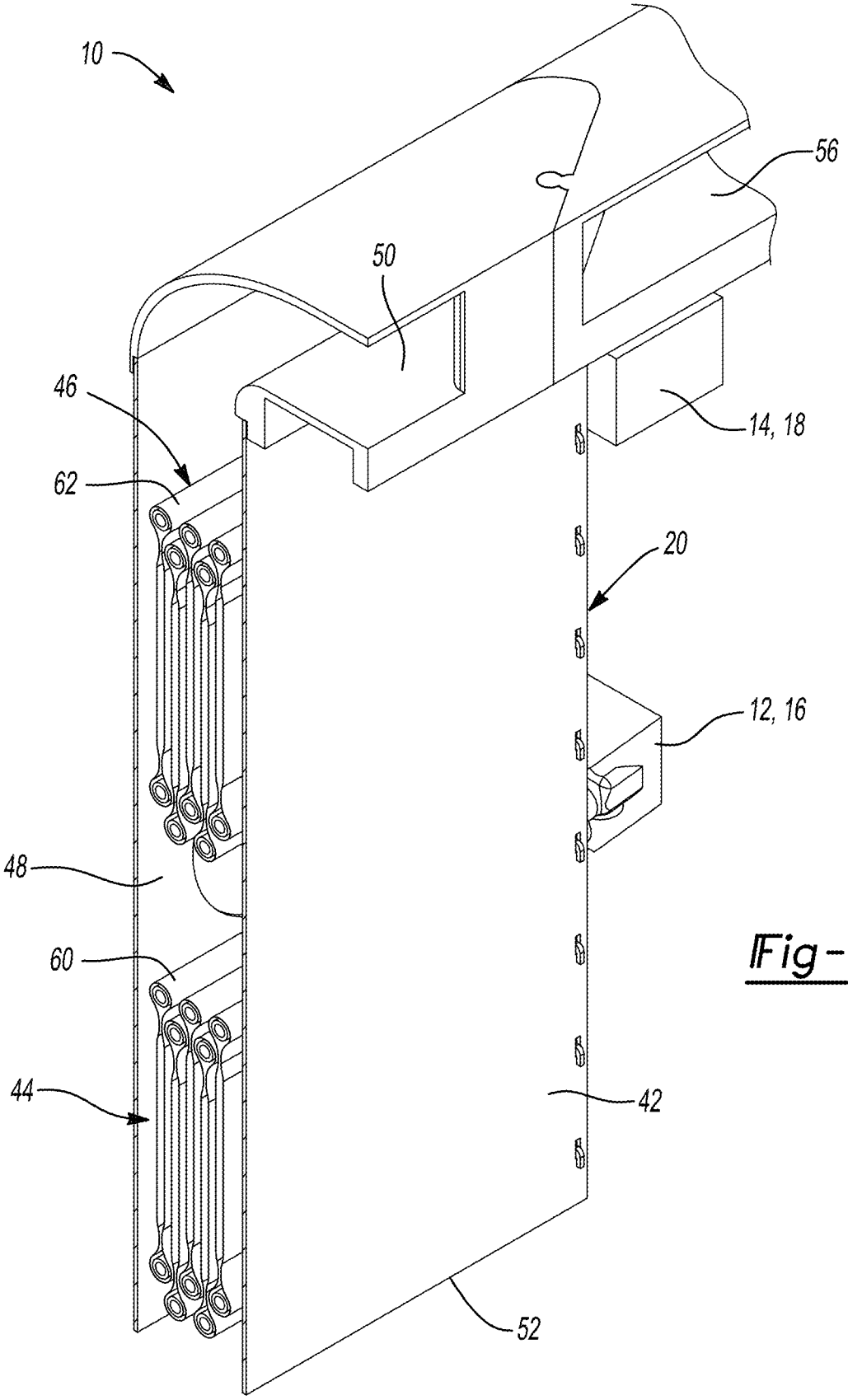
FIG. 6 is a cross-sectional perspective view of the climate-control system.

As shown in FIGS. 1 and 2, each of the first and second reversing valves 16, 18 may include a housing having first, second, third, and fourth ports 30, 32, 34, 36 and a movable valve member having first and second passages 38, 40. The movable valve member is disposed within the housing and is movable (e.g., via an electromechanical actuator) relative to the housing between first and second positions. When the system 10 is in the cooling mode (FIG. 1), the first reversing valve 16 is in the first position (in which the first passage 38 fluidly connects the first and second ports 30, 32 and the second passage 40 fluidly connects the third and fourth ports 34, 36) and the second reversing valve 18 is in the second position (in which the first passage 38 fluidly connects the second and third ports 32, 34 and the second passage 40 fluidly connects the first and fourth ports 30, 36). When the system 10 is in the heating mode (FIG. 2), the first reversing valve 16 is in the second position (in which the first passage 38 fluidly connects the first and fourth ports 30, 36 and the second passage 40 fluidly connects the second and third ports 32, 34) and the second reversing valve 18 is in the first position (in which the first passage 38 fluidly connects the first and second ports 30, 32 and the second passage 40 fluidly connects the third and fourth ports 34, 36).

The heat-exchanger unit 20 may include a housing 42, a first heat exchanger 44, and a second heat exchanger 46. The first and second heat exchangers 44, 46 may be disposed within an internal cavity 48 (FIGS. 5 and 6) of the housing 42. In some configurations, the compressor/turbines 12, 14 and/or the reversing valves 16, 18 may be attached to or mounted to the housing 42.

The housing 42 may include a first air inlet (e.g., a return-air inlet) 50, a second air inlet (e.g., an outdoor-air inlet) 52, one or more first air outlets (e.g., air-exhaust outlets) 54, and a second air outlet (e.g., a supply-air outlet) 56. The return-air and outdoor-air inlets 50, 52 and the air-exhaust outlets 54 are in fluid communication with the internal cavity 48. One or more fans 58 (FIGS. 1 and 2) may draw air into the internal cavity 48 via the return-air and outdoor-air inlets 50, 52 and force air out of the internal cavity 48 through the air-exhaust outlets 54. Air exiting the air-exhaust outlets 54 may be exhausted outdoors (i.e., back outside of the building or space to be cooled via an outdoor vent duct, for example). The supply-air outlet 56 is fluidly isolated from air in the internal cavity 48. FIGS. 3-6 show the supply-air outlet 56 being attached to the housing 42. However, in some configurations, the supply-air outlet 56 may be separate from the housing 42.

The first and second heat exchangers 44, 46 may be air-to-air heat exchangers. That is, air flowing inside of the first heat exchanger 44 is in a heat-transfer relationship with air flowing around the exterior of the first heat exchanger 44. Likewise, air flowing inside of the second heat exchanger 46 is in a heat-transfer relationship with air flowing around the exterior of the second heat exchanger 46.

As noted above, the first and second heat exchangers 44, 46 are disposed within the internal cavity. The first and second heat exchangers 44, 46 may include coils or pipes 60, 62, respectively. As shown in FIGS. 1 and 2, the pipes 60, 62 are in fluid communication with each other via a conduit 64 (which may be disposed inside or outside of the internal cavity 48). The pipe(s) 60 of the first heat exchanger 44 may receive air from the first reversing valve 16. The pipe(s) 62 of the second heat exchanger 46 may provide air to the second reversing valve 18. Air flowing inside of the pipes 60, 62 is fluidly isolated from air in the internal cavity 48. That is, air that flows into the internal cavity 48 from the return-air and outdoor-air inlets 50, 52 is fluidly isolated from the air flowing within the pipes 60, 62. However, the air inside of the internal cavity 48 (i.e., the air from the return-air and outdoor-air inlets 50, 52) is in a heat-transfer relationship with the air inside of the pipes 60, 62. That is, when the system 10 is in the cooling mode (FIG. 1), the air inside of the internal cavity 48 (i.e., the air from the return-air and outdoor-air inlets 50, 52) absorbs heat from air flowing inside of the pipes 60, 62. When the system 10 is in the heating mode (FIG. 2), the air flowing inside of the pipes 60, 62 absorbs heat from air inside of the internal cavity 48 (i.e., the air from the return-air and outdoor-air inlets 50, 52).

As shown in FIGS. 1 and 2, the pipe(s) 60 of the first heat exchanger 44 may be in fluid communication with (i.e., receive air from) the third port 34 of the first reversing valve 16. The pipe(s) 62 of the second heat exchanger 46 may be in fluid communication with (i.e., provide air to) the first port 30 of the second reversing valve 18.

As shown in FIGS. 1 and 2, the first port 26 of the first compressor/turbine 12 may be in fluid communication with the fourth port 36 of the first reversing valve 16. The second port 28 of the first compressor/turbine 12 may be in fluid communication with the second port 32 of the first reversing valve 16. The first port 30 of the first reversing valve 16 may be in fluid communication with (i.e., receive air from) an outdoor-air conduit 66. The outdoor-air conduit 66 may receive air from a source of outdoor-ambient air such as the outdoor-air inlet 52 or from another outdoor air vent, for example.

As shown in FIGS. 1 and 2, the first port 26 of the second compressor/turbine 14 may be in fluid communication with the fourth port 36 of the second reversing valve 18. The second port 28 of the second compressor/turbine 14 may be in fluid communication with the second port 32 of the second reversing valve 18. The third port 34 of the second reversing valve 18 may be in fluid communication with (i.e., provide air to) the supply-air outlet 56.

With reference to FIG. 1, operation of the system 10 in the cooling mode will be described in detail. As described above and shown in FIG. 1, when the system 10 is operating in the cooling mode: the first reversing valve 16 is in the first position, the second reversing valve 18 is in the second position, the first compressor/turbine 12 is operating in the compressor mode, the second compressor/turbine 14 is operating in the turbine mode, and the fans 58 operate to draw air into the internal cavity 48 from the return-air and outdoor-air inlets 50, 52 and exhaust air from the internal cavity 48 through the air-exhaust outlet(s) 54.

Therefore, in the cooling mode, air from the source of outdoor-ambient air flows through the outdoor-air conduit 66, through the first and second ports 30, 32 of the first reversing valve 16, and into the second port 28 of the first compressor/turbine 12. The first compressor/turbine 12 compresses the air from a first pressure (e.g., outdoor-ambient air pressure) to a second pressure that is higher than the first pressure.

The compressed air exits the first compressor/turbine 12 through the first port 26 at the second pressure (and at a higher temperature than it entered the first compressor/turbine 12). From the first port 26 of the first compressor/turbine 12, the air flows through the first reversing valve 16 (i.e., through the fourth port 36, second passage 40, and third port 34) and through the pipe(s) 60 of the first heat exchanger 44. As the compressed and heated air flows through the pipe(s) 60 of the first heat exchanger 44, air flowing through the internal cavity 48 of the heat exchanger unit 20 (e.g., air flowing from the outdoor-air inlet 52 to the air-exhaust outlets 54) may absorb heat from the air flowing within the pipe(s) 60, thereby lowering the temperature of the air in the pipe(s) 60.

Air in the pipe(s) 60 of the first heat exchanger 44 then flows to the pipe(s) 62 of the second heat exchanger 46 (via the conduit 64). Air flowing through the internal cavity 48 of the heat exchanger unit 20 (e.g., air flowing from the return-air inlet 50 to the air-exhaust outlets 54) may absorb heat from the air flowing within the pipe(s) 62, thereby further lowering the temperature of the air in the pipe(s) 62.

From the pipe(s) 62, the air may flow through the second reversing valve (i.e., through the first port 30, second passage 40, and fourth port 36) and flow into the second compressor/turbine 14 via the first port 26. As described above, the second compressor/turbine 14 operates in the turbine mode when the system 10 is in the cooling mode. Therefore, the air is expanded (its pressure is reduced) as it flows through the second compressor/turbine 14 from the first port 26 to the second port 28. Reducing the pressure of the air in this manner further lowers the temperature of the air. The cooled and reduced-pressure air then flows from the second port 28 of the second compressor/turbine 14 through the second reversing valve 18 (i.e., through the second port 32, first passage 38, and third port 34) and flows through the supply-air outlet 56 to the room or space to be cooled.

With reference to FIG. 2, operation of the system 10 in the heating mode will be described in detail. As described above and shown in FIG. 2, when the system 10 is operating in the heating mode: the first reversing valve 16 is in the second position, the second reversing valve 18 is in the first position, the first compressor/turbine 12 is operating in the turbine mode, the second compressor/turbine 14 is operating in the compressor mode, and the fans 58 operate to draw air into the internal cavity 48 from the return-air and outdoor-air inlets 50, 52 and exhaust air from the internal cavity 48 through the air-exhaust outlet(s) 54.

Therefore, in the heating mode, air from the source of outdoor-ambient air flows through the outdoor-air conduit 66, through the first and fourth ports 30, 36 of the first reversing valve 16, and into the first port 26 of the first compressor/turbine 12. The first compressor/turbine 12 operates in the turbine mode when the system 10 is in the heating mode, and therefore, the first compressor/turbine 12 expands the air from outdoor-ambient air pressure to a pressure lower than outdoor-ambient air pressure (which also lowers the temperature of the air).

The cooled and reduced-pressure air exits the first compressor/turbine 12 through the second port 28. From the second port 28 of the first compressor/turbine 12, the air flows through the first reversing valve 16 (i.e., through the second port 32, first passage 38, and third port 34) and through the pipe(s) 60 of the first heat exchanger 44. As the cooled and reduced-pressure air flows through the pipe(s) 60 of the first heat exchanger 44, air flowing through the internal cavity 48 of the heat exchanger unit 20 (e.g., air flowing from the outdoor-air inlet 52 to the air-exhaust outlets 54) may transfer heat to the air flowing within the pipe(s) 60, thereby raising the temperature of the air in the pipe(s) 60.

Air in the pipe(s) 60 of the first heat exchanger 44 then flows to the pipe(s) 62 of the second heat exchanger 46 (via the conduit 64). Air flowing through the internal cavity 48 of the heat exchanger unit 20 (e.g., air flowing from the return-air inlet 50 to the air-exhaust outlets 54) may transfer heat to the air flowing within the pipe(s) 62, thereby further raising the temperature of the air in the pipe(s) 62.

From the pipe(s) 62, the air may flow through the second reversing valve (i.e., through the first port 30, first passage 38, and second port 32) and flow into the second compressor/turbine 14 via the second port 28. As described above, the second compressor/turbine 14 operates in the compressor mode when the system 10 is in the heating mode. Therefore, the air is compressed (its pressure is increased) as it flows through the second compressor/turbine 14 from the second port 28 to the first port 26. Compressing the air in this manner (e.g., raising the pressure of the air back up to a pressure at or near outdoor-ambient pressure or air pressure in the room or space to be heated) further raises the temperature of the air. The heated air then flows from the first port 26 of the second compressor/turbine 14 through the second reversing valve 18 (i.e., through the fourth port 36, second passage 40, and third port 34) and flows through the supply-air outlet 56 to the room or space to be heated.

FIGS. 1 and 2 show example air temperatures at various locations throughout the system 10 in the cooling and heating modes, respectively. These air temperatures are only examples and are provided only for illustration purposes. Actual air temperature values may vary depending on a variety of factors, such as outdoor air temperature, capacities of the compressor/turbines, return air temperature, materials and construction of the heat exchangers, air flow rates, etc.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A climate-control system comprising:

a first turbomachine fluidly connected with a source of outdoor air and operable in a compressor mode and in an expander mode, wherein the first turbomachine is configured to compress air in the compressor mode and expand air in the expander mode;

a second turbomachine operable in a compressor mode and in an expander mode, wherein the second turbomachine is configured to compress air in the compressor mode and expand air in the expander mode;

a first heat exchanger fluidly connected to the first turbomachine and receiving air from the first turbomachine in the compressor mode and in the expander mode;

a second heat exchanger fluidly connected to the first heat exchanger and the second turbomachine, wherein the second heat exchanger receives air from the first heat exchanger, and wherein the second heat exchanger provides air to the second turbomachine in the compressor mode and in the expander mode; and one or more fans that force air from the source of outdoor air across an exterior of the first heat exchanger and force indoor return air across an exterior of the second heat exchanger, wherein the air flowing across the exterior of the first heat exchanger is fluidly isolated from air flowing inside of the first heat exchanger, and wherein the return air flowing across the exterior of the second heat exchanger is fluidly isolated from air flowing inside of the second heat exchanger.

2. The climate-control system of claim 1, wherein the first and second heat exchangers are disposed within an internal cavity of a housing.

3. The climate-control system of claim 2, wherein the housing includes a return-air inlet, an outdoor-air inlet, and an air-exhaust outlet.

4. The climate-control system of claim 3, wherein the one or more fans force air from the source of outdoor air into the internal cavity of the housing through the outdoor-air inlet and force the return air into the internal cavity of the housing through the return-air inlet.

5. The climate-control system of claim 4, wherein the one or more fans force the air from the source of outdoor air and the return air out of the internal cavity of the housing after the air from the source of outdoor air and the return air flow across the exteriors of the first and second heat exchangers, respectively.

6. The climate-control system of claim 5, wherein the air-exhaust outlet is disposed between the return-air inlet and the outdoor-air inlet.

7. The climate-control system of claim 5, wherein the first and second turbomachines are disposed outside of the internal cavity of the housing.

8. The climate-control system of claim 7, further comprising a supply-air outlet that receives air from the second turbomachine and provides the air to an indoor space.

9. The climate-control system of claim 8, wherein the supply-air outlet is attached to the housing, and wherein air flowing through the supply-air outlet is fluidly isolated from air within the internal cavity flowing across the exteriors of the first and second heat exchangers.

10. The climate-control system of claim 9, wherein the return-air inlet and the supply-air outlet are disposed adjacent to each other at a first end of the housing.

11. The climate-control system of claim 10, wherein the outdoor-air inlet is disposed at a second end of the housing opposite the first end.

12. The climate-control system of claim 11, wherein the air-exhaust outlet is disposed between the first and second ends of the housing.

13. The climate-control system of claim 8, further comprising:

a first reversing valve in fluid communication with the first turbomachine and the first heat exchanger; and a second reversing valve in fluid communication with the second turbomachine and the second heat exchanger, wherein the first and second reversing valves are movable between first and second positions.

14. The climate-control system of claim 13, wherein the climate-control system is operable in a cooling mode and in a heating mode, wherein in the cooling mode: the first turbomachine operates in the compressor mode, the first reversing valve is in the first position, the second turbomachine operates in the expander mode, and the second reversing valve is in the second position, and wherein in the heating mode: the first turbomachine operates in the expander mode, the first reversing valve is in the second position, the second turbomachine operates in the compressor mode, and the second reversing valve is in the first position.

15. The climate-control system of claim 14, wherein each of the first and second turbomachines includes a first port and a second port, wherein the first port is an outlet in the compressor mode and the second port is an inlet in the compressor mode, and wherein the first port is an inlet in the expander mode and the second port is an outlet in the expander mode.

16. The climate-control system of claim 15, wherein in the cooling mode:

air flows from the first reversing valve to the second port of the first turbomachine, air flows from the first port of the first turbomachine to the first reversing valve, air flows from the second reversing valve to the first port of the second turbomachine, and air flows from the second port of the second turbomachine to the second reversing valve.

17. The climate-control system of claim 16, wherein in the heating mode:

air flows from the first reversing valve to the first port of the first turbomachine, air flows from the second port of the first turbomachine to the first reversing valve, air flows from the second reversing valve to the second port of the second turbomachine, and air flows from the first port of the second turbomachine to the second reversing valve.

18. The climate-control system of claim 17, wherein air from the first turbomachine flows to the first heat exchanger and subsequently to the second heat exchanger in the cooling mode and in the heating mode.

19. The climate-control system of claim 18, further comprising an outdoor-air conduit configured to receive outdoor ambient air from the source of outdoor air and provide the outdoor ambient air to the first turbomachine via the first reversing valve in the cooling mode and in the heating mode.

20. The climate-control system of claim 19, wherein the first and second reversing valves are mounted to the housing outside of the internal cavity.

* * * * *